US008807383B2

(12) United States Patent
Weng et al.

(10) Patent No.: US 8,807,383 B2
(45) Date of Patent: Aug. 19, 2014

(54) GASOLINE STORAGE DEVICE

(71) Applicant: Full Most Co., Ltd., New Taipei (TW)

(72) Inventors: Ming-Chun Weng, New Taipei (TW); Ming-Tsang Yu, New Taipei (TW); Wen-Pin Pen, New Taipei (TW); Yu-Chi Li, New Taipei (TW)

(73) Assignee: Full Most Co., Ltd., New Taipei (TW)

( * ) Notice: Subject to any disclaimer, the term of this patent is extended or adjusted under 35 U.S.C. 154(b) by 0 days.

(21) Appl. No.: 13/768,813

(22) Filed: Feb. 15, 2013

(65) Prior Publication Data

US 2013/0213974 A1 Aug. 22, 2013

(30) Foreign Application Priority Data

Feb. 17, 2012 (TW) ..... 101202998 A

(51) Int. Cl.
*B65D 88/00* (2006.01)
*B65D 88/76* (2006.01)
*B65D 88/34* (2006.01)

(52) U.S. Cl.
USPC ..... 220/567.2; 220/567.1; 220/495.01; 220/216

(58) Field of Classification Search
CPC ..... B65D 88/00; B65D 88/76; B65D 88/34; B65D 88/38; B65D 88/62; B65D 90/046; B65D 90/38; B65D 90/506; B65D 90/022; B65D 90/503; B65D 90/24
USPC ..... 220/567.2, 565, 1.6, 495.01, 495.05, 220/495.06, 219, 216, 218, 220, 567.1; 383/41, 42, 44, 105
See application file for complete search history.

(56) References Cited

U.S. PATENT DOCUMENTS

| | | | | | |
|---|---|---|---|---|---|
| 1,674,104 | A * | 6/1928 | Gallagher | 220/219 |
| 1,717,100 | A * | 6/1929 | Downes | 210/603 |
| 2,758,747 | A * | 8/1956 | Stevens | 220/530 |
| 3,049,261 | A * | 8/1962 | Wade et al. | 220/216 |
| 3,240,381 | A * | 3/1966 | Smith | 220/216 |
| 3,747,800 | A * | 7/1973 | Viland | 220/723 |
| 4,249,669 | A * | 2/1981 | Szego | 220/216 |
| 4,295,504 | A * | 10/1981 | Hasselmann | 141/290 |
| 4,763,805 | A * | 8/1988 | Strock | 220/723 |
| 4,796,676 | A * | 1/1989 | Hendershot et al. | 141/83 |
| 5,000,342 | A * | 3/1991 | Sharp | 220/567.1 |
| 5,913,451 | A * | 6/1999 | Madison | 220/723 |
| 6,929,142 | B2 * | 8/2005 | Gilbert et al. | 220/216 |
| 2008/0164261 | A1 * | 7/2008 | Weber et al. | 220/560.03 |

* cited by examiner

*Primary Examiner* — Steven A. Reynolds
*Assistant Examiner* — Javier A Pagan
(74) *Attorney, Agent, or Firm* — Muncy, Geissler, Olds & Lowe, P.C.

(57) ABSTRACT

A gasoline storage device, which is regulated to prevent gasoline from vaporizing, and is fabricated from a soft gasoline bag made from soft material that has been processed and coated on both sides so as to be resistant against gasoline and the majority of chemical liquids. The soft gasoline bag can be folded into a small size, directly disposed into a steel gasoline tank and allowed to unfold. Expandable hoses are used to respectively connect to the existing gasoline inlet pipe, gasoline-measuring pipe and manhole of the steel gasoline tank. The soft properties of the soft gasoline bag are used to isolate the gasoline stored within the steel gasoline tank from the air, thereby reducing vaporization of gasoline, pollution and wastage.

7 Claims, 4 Drawing Sheets

GASOLINE STORAGE DEVICE

BACKGROUND OF THE INVENTION (a) Field of the Invention

The present invention relates to a container for storing gasoline, and more particularly to a device able to function directly with an existing fuel tank in a gas station, and which improves the problems of safety in gasoline storage, as well as preventing leakage and pollution.

(b) Description of the Prior Art

FIG. 1 depicts a gasoline storage device of a common gas station, comprising a plurality of steel gasoline tanks A buried underground, with the ground provided with preformed manhole. The steel gasoline tank A depicted in the diagram is fitted with an air vent B extending to the ground, a gasoline outlet pipe C connected to a gasoline pump F on a gasoline filling island (pump island), and a gasoline filling pipe D and a gasoline-measuring pipe E extending to the position of the manhole. A gasoline carrier fills the steel gasoline tanks with gasoline for storage thereof through gasoline filling pipes. When vehicles are refueling, the gasoline pumps are started and gasoline within the steel gasoline tanks are pumped out through gasoline outlet pipes.

Because during construction operations related to the steel gasoline tanks involving burying, anti corrosion coating and pipeline burying, links in the construction procedure cannot be known with absolute certainty, thus, the result is that the steel gasoline tanks or the anti corrosion coating is subject to damage causing a reduction in the serviceable life thereof. Moreover, external factors such as harmful operations management, cathodic and anodic corrosion protection function not achieving effectiveness, and so on, cause the steel gasoline tanks to corrode and leak, adding to the apprehension of the gas station owner. Furthermore, problems of land or underground water contamination during operations are often neglected by the proprietor. In addition, installations including the gasoline storage tanks buried underground are even more neglected by the proprietor because of the difficulties in inspecting them. Pollution gradually broadens in range with time, and is usually only taken seriously once the pollution spreads to the extent that it is endangering the environment or affecting the health of humans, at which time the proprietor must not only bear the huge expense of cleaning up the pollution, but also pay a large compensation or reimburse expenses incurred.

SUMMARY OF THE INVENTION

The first objective of the present invention lies in resolving the problems of a gas station equipped with an underground gasoline storage device of the prior art, functioning together with other gasoline transfer equipment, easily resulting in gasoline leakage and pollution of the environment due to many factors during the entire operating procedure.

The characteristics of the present invention provide a soft gasoline bag that is flexible and foldable, firm and tenacious and anticorrosive. The soft gasoline bag, in a folded state, can be installed within an existing steel gasoline tank, and uses the gasoline inlets, gasoline measuring holes and manhole provided in the same positions of the existing steel gasoline tank. After gasoline is poured into the soft gasoline bag, then the soft gasoline bag is caused to expand within the steel gasoline tank until it fills the space within the steel gasoline tank, thereby providing the same functions to store gasoline and supply gasoline. However, the soft gasoline bag ensures that the problem of gasoline leakage will not occur should the steel gasoline tank be damaged during construction or other external reasons.

The technicalities of the soft gasoline bag of the present invention comprises soft material formed to provide a first internal space able to store gasoline. A sidewall of the soft gasoline bag is equipped with a set of floating plates, and the set of floating plates is provided with a first gasoline inlet, a first gasoline measuring hole and a first manhole affording passages to the first internal space. The first gasoline inlet is equipped with a gasoline inlet hose, the first gasoline measuring hole is equipped with a gasoline measuring hose, and the first manhole is equipped with a manhole hose. When folded into a small size, the soft gasoline bag is disposed directly within the steel gasoline tank, and enables the gasoline inlet hose, the gasoline measuring hose and the manhole hose to be respectively fixedly connected to a second gasoline inlet, a second gasoline measuring hole and a second manhole of the steel gasoline tank, thereby enabling use of the soft gasoline bag to store and supply gasoline from within the steel gasoline tank.

A frame is further installed to the sidewall of the soft gasoline bag of the present invention, and the aforementioned set of floating plates is fitted within the dimensions of the frame. Hence, when gasoline is poured into the soft gasoline bag or when gasoline is being pumped therefrom, the set of floating plates is subjected to the buoyancy of the gasoline, and rises or falls accordingly, thereby ensuring stability of the connecting interfaces between the soft gasoline bag and the gasoline transfer pipe and the gasoline filling pipe, thus preventing loosening thereof from occurring.

The steel gasoline tank of the the present invention used to function together with the soft gasoline bag is further provided with a second internal space, which is provided with a second gasoline inlet, a second gasoline measuring hole and a second manhole affording passages to the second internal space. The gasoline inlet hose fitted to the soft gasoline bag is fixed to the second gasoline inlet, the gasoline measuring hose is fixed to the second gasoline measuring hole, and the manhole hose is fixed to the second manhole.

The gasoline inlet hose, the gasoline measuring hose and the manhole hose fitted to the soft gasoline bag of the present invention can be expandable hoses provided with collaring.

The material used to manufacture the soft gasoline bag of the present invention can be polyurethane fabric material which has been heated and pressed to form a material coated with thermoplastic polyurethane (TPU). Such material is provided with the excellent characteristics of gasoline separation, gasoline resistance, antihydrolysis and aging resistance, as well as having a soft quality, thereby providing the soft gasoline bag of the present invention with the advantages of not contaminating the quality of the gasoline, a long serviceable life, and does not need any special maintenance.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
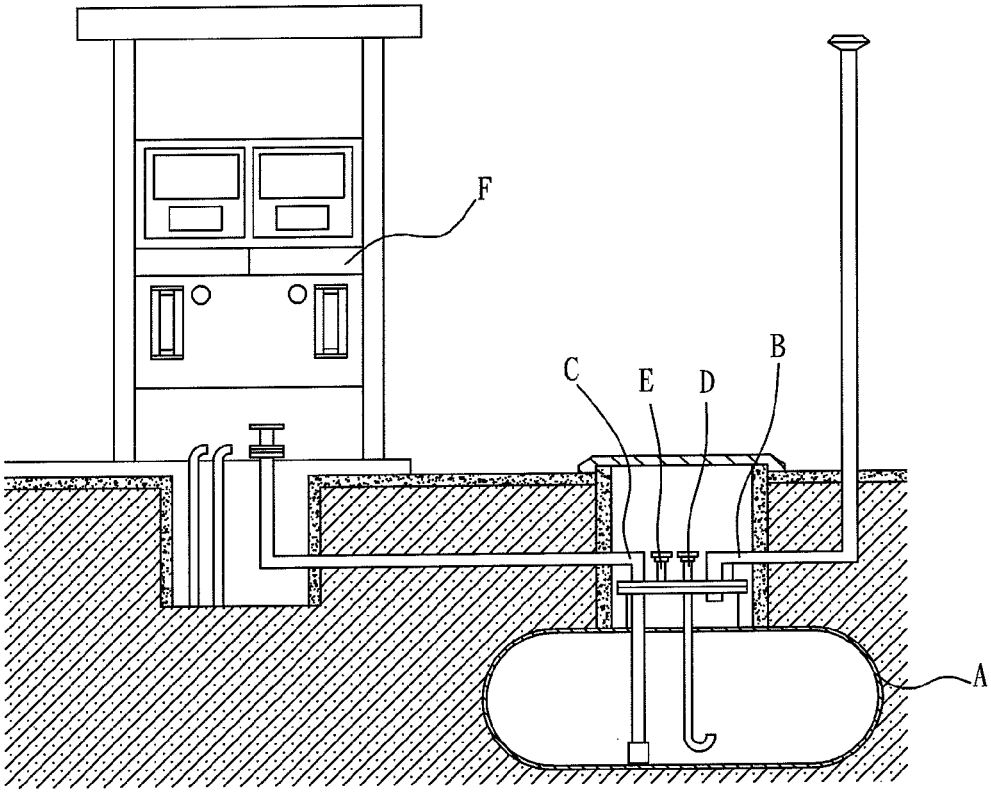
FIG. 1 Prior Art
FIG. 1 is a schematic view depicting a gasoline storage device Installed in a common gas station of the prior art.
Figure 2A:
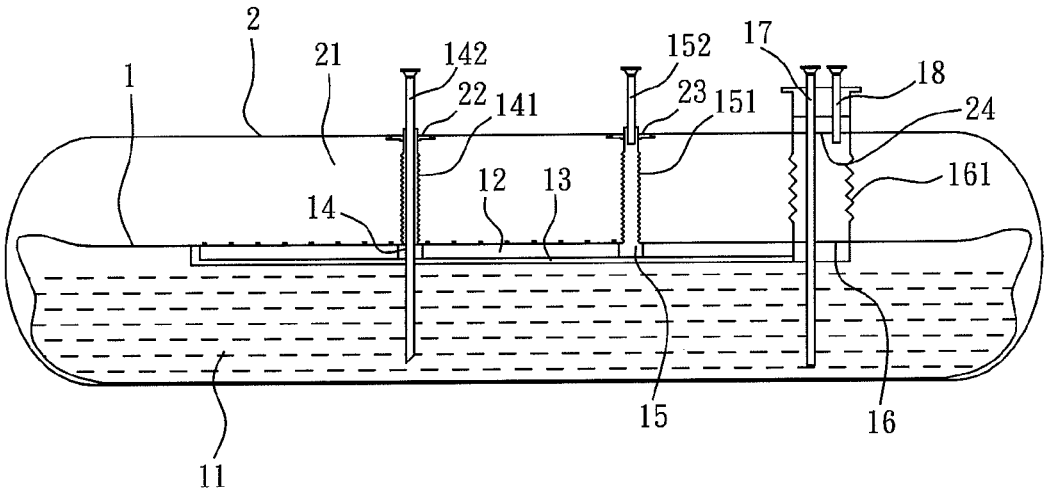
FIG. 2A is a planar schematic view depicting an embodiment of a soft gasoline bag of the present invention installed in a steel gasoline tank, showing initial expansion of the soft gasoline bag after filling with gasoline.
Figure 2B:
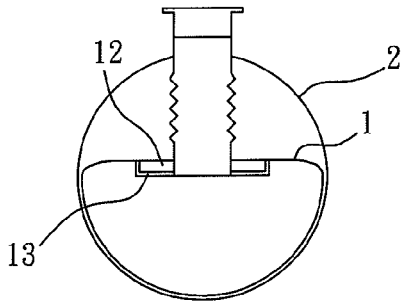
FIG. 2B is a side view of FIG. 2A.
Figure 4:
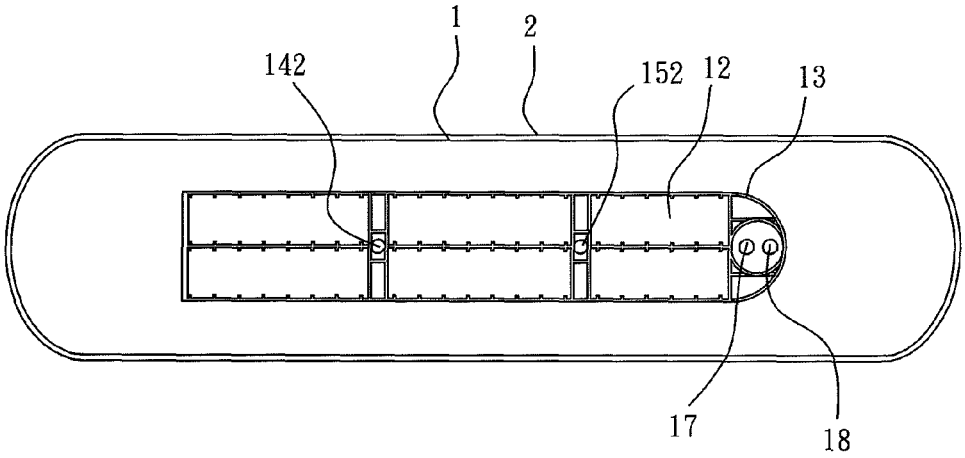
FIG. 4 is a top planar schematic view depicting an embodiment of the soft gasoline bag of the present invention installed within the steel gasoline tank.

Referring to FIG. 2A and FIG. 2B, the present invention provides a gasoline storage device, a preferred embodiment of which comprises a soft gasoline bag 1 manufactured from soft material. The soft gasoline bag 1 is provided with a first internal space 11 able to store gasoline, and a set of floating plates 12 fitted to a sidewall of the soft gasoline bag 1. The set of floating plates 12 is fitted within the dimensions of a frame 13, and the frame 13 is used to coordinate fixing the set of floating plates 12 to the sidewall of the soft gasoline bag 1, thereby enabling the set of floating plates 12 and the frame 13 to be positioned at the upper portion of the soft gasoline bag 1 (see FIG. 4). The described set of floating plates 12 is provided with a first gasoline inlet 14, a first gasoline measuring hole 15 and a first manhole 16 affording passages to the first internal space 11. The first gasoline inlet 14 is fitted with a gasoline inlet hose 141; the first gasoline measuring hole 15 is fitted with a gasoline measuring hose 151; and the first manhole 16 is fitted with a manhole hose 161. It is preferred that expandable hoses, provided with a plurality of collaring and able to flexibly expand, are used for the described gasoline inlet hose 141, the gasoline measuring hose 151 and the manhole hose 161.

Furthermore, the material used to manufacture the soft gasoline bag 1 of the present invention is polyurethane fabric material which has been heated and pressed to form a material coated with thermoplastic polyurethane (TPU) having the excellent properties of high strength, puncture resistance, anti-tearing and resistance to low temperatures. Such material is provided with the excellent characteristics of gasoline separation, gasoline resistance, antihydrolysis and aging resistance, as well as having a soft quality, thereby providing the advantages of not contaminating the quality of the gasoline, a long serviceable life, and does not need any special maintenance. The material is cut out and undergoes high frequency welding, heating and pressing to form and produce the soft gasoline bag 1 of the present invention.

In addition, the gasoline storage device of the present invention further comprises a steel gasoline tank 2 provided with a second internal space 21. The steel gasoline tank 2 is provided with a second gasoline inlet 22, a second gasoline measuring hole 23 and a second manhole 24 affording passages to the second internal space 21. It is preferred that the positions of the second gasoline inlet 22, the second gasoline measuring hole 23 and the second manhole 24 respectively correspond to the positions of the first gasoline inlet 14, first gasoline measuring hole 15 and the first manhole 16 of the soft gasoline bag 1.

The soft gasoline bag 1 of the present invention is installed directly within the second internal space 21 of the steel gasoline tank 2. The installation method consists of folding the soft gasoline bag 1 into a flat small size and disposing it into the second internal space 21 through the second manhole 24 of the steel gasoline tank 2. The gasoline inlet hose 141 of the soft gasoline bag 1 is then connected to the second gasoline inlet 22 and securely fixed; the gasoline measuring hose 151 is connected to the second gasoline measuring hole 23 and securely fixed; and the manhole hose 161 is connected to the second manhole 24 and securely fixed. In addition, a gasoline inlet pipe 142 is then insertedly disposed into the gasoline inlet hose 141; a gasoline-measuring pipe 152 is insertedly disposed into the gasoline measuring hose 151; and a gasoline outlet pipe 17 and a vent pipe 18 are insertedly disposed into the manhole hose 161. The described gasoline inlet pipe 142 enables gasoline to be poured into the soft gasoline bag 1; the gasoline outlet pipe 17 enables connection to a gasoline filling pump on a gasoline filling island through a gasoline delivery pipe (not shown in the diagrams). The vent pipe 18 is used to allow air convection within the soft gasoline bag 1 when gasoline is entering the soft gasoline bag 1.

The characteristics of the gasoline storage device of the present invention when in use include the described soft gasoline bag 1 being able to function directly together with a steel gasoline tank buried underground a current gas station, and thus does not need the addition of extra steel gasoline tanks. Installation is also very convenient, only needing the existing interior of the steel gasoline tank 2 buried underground a gas station to be first cleaned completely; the folded soft gasoline bag 1 is then disposed into the second internal space 21 through the second manhole 24 and allowed to unfold, after which the aforementioned buoyant set of floating plates 12, the gasoline inlet hose 141, the gasoline measuring hose 151 and the manhole hose 161 are respectively connected to the second gasoline inlet 22, the second gasoline measuring hole 23 and the second manhole 24 of the steel gasoline tank 2, thereby completing the installation. No other major adjustments are needed for other installation procedures.

Figure 3A:
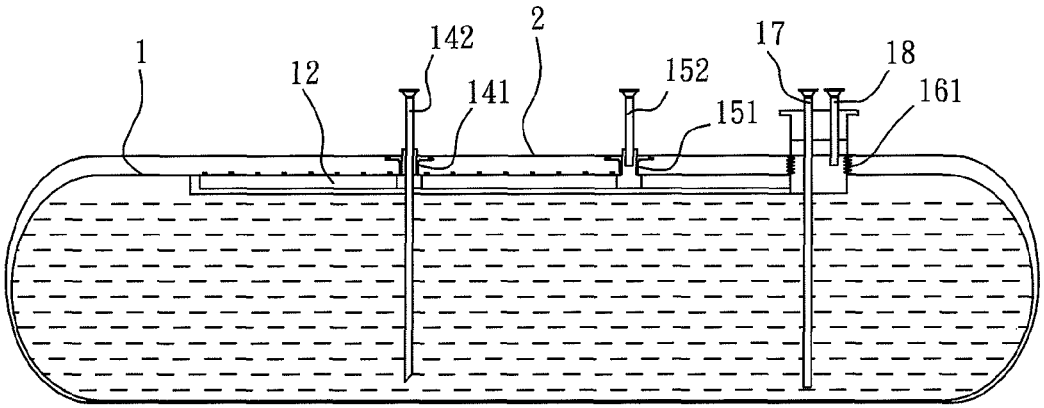
FIG. 3A is a planar schematic view depicting an embodiment of the soft gasoline bag of the present invention expanded to the limit within the steel gasoline tank.
Figure 3B:
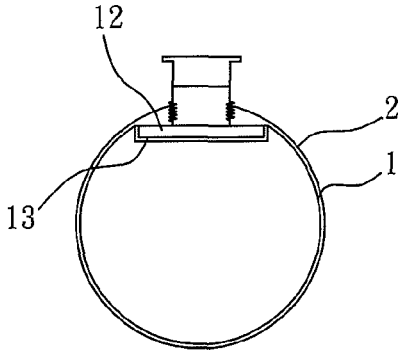
FIG. 3B is a side view of FIG. 3A.

Because the gasoline inlet hose 141, the gasoline measuring hose 151 and the manhole hose 161 fitted to the soft gasoline bag 1 of the present invention are of soft nature and flexibly expandable, and are able to freely rise and fall along with the set of floating plates 12, thus, as gasoline is poured into the first internal space 11 of the soft gasoline bag 1 through the gasoline inlet pipe 142, the set of floating plates 12 is subjected to the buoyancy of the gasoline and rises along with the liquid surface (as depicted in FIG. 3A and FIG. 3B). The air in the interlayer between the soft gasoline bag 1 and the steel gasoline tank 2 is sufficiently isolated from the gasoline, and does not cause the gasoline to vaporize. Moreover, the soft gasoline bag 1 is supported by the steel gasoline tank 2, which can prevent the production of static electricity, and thus guarantee safety of the device. When unloading gasoline, the upper surface of the soft gasoline bag 1 and the liquid surface of the gasoline fall together along with the gasoline being pumped out from the gasoline outlet pipe 17. The interlayer between the soft gasoline bag 1 and the steel gasoline tank 2 is naturally filled with air while isolation of the gasoline from the interlayer air is still sufficiently maintained, thereby preventing the gasoline from vaporizing.

The gasoline storage device of the present invention is provided with following advantages:

1. Rapid Installation

An existing storage tank buried underground a gas station can serve as a steel gasoline tank, and then converted by installing the soft gasoline bag for immediate use. Installation is extremely convenient and only needs the steel gasoline tank to be cleaned, after which inspection is made to ensure there are no protruding sharp objects within the steel gasoline tank. The folded soft gasoline bag is then disposed into the steel gasoline tank through the second manhole and allowed to unfold. The gasoline inlet hose, the gasoline measuring hose and the manhole hose fitted to the soft gasoline bag are then respectively connected to the second gasoline inlet, the second gasoline measuring hole and the second manhole of the steel gasoline tank. No other major adjustments are needed for other installation procedures. Starting from cleaning the underground steel gasoline tank to completion of the installation only requires 3~5 workdays.

2. Reduces Damage, and Rate of Vaporization of Gasoline is Close to 0%

Because the soft gasoline bag naturally flattens on the bottom portion of the steel gasoline tank when empty, thus, when loading and unloading gasoline, the soft gasoline bag expands and rises, falls and shrinks and flattens along with the internal liquid. There is almost no air present in the interior of the soft gasoline bag, and the interlayer air between the interior of the steel gasoline tank and the soft gasoline bag is sufficiently isolated from the gasoline, thereby enabling a rate of vaporization rate close to 0%.

3. Multiple Protection, Extensively Increasing Safety

When building a gas station, apart from there being no stipulations in the protective laws and regulations regarding the original water pollution, during the course of using the soft gasoline bag, if human factors cause rupture of the soft gasoline bag, because of the original outer layer steel gasoline tank serving as supplementary protection, there is no immediate danger, and the internal gasoline will not directly leak out. Accordingly, the present invention provides an additional layer of protection.

4. Long Serviceable Life, Maintenance is Easy and Fast

The soft gasoline bag used in the present invention adopts special TPU coated gasoline resistant and water resistant material, and 10 years of normal use will not result in any problems. Existing or additionally installed monitoring instruments can be used to know whether or not there are any abnormalities. Maintenance operation of the soft gasoline bag only requires first transferring the internally stored gasoline, and then cleaning the tank using a standard cleaning procedure. The soft gasoline bag is then removed for repair or renewal, after which the soft gasoline bag can be can returned for continued use.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A gasoline storage device, comprising:

a soft gasoline bag, the soft gasoline bag is made from soft material and provided with a first internal space able to store gasoline, a sidewall of the soft gasoline bag is fitted with a set of floating plates, the set of floating plates is provided with a first gasoline inlet, a first gasoline measuring hole and a first manhole affording passages to the first internal space; the first gasoline inlet is fitted with a gasoline inlet hose, the first gasoline measuring hole is fitted with a gasoline measuring hose, and the first manhole is fitted with a manhole hose.

2. The gasoline storage device according to claim 1, wherein the sidewall of the soft gasoline bag is equipped with a frame, and the set of floating plates is fitted within the dimensions of the frame.

3. The gasoline storage device according to claim 1, wherein the gasoline storage device further comprises a steel gasoline tank provided with a second internal space; wherein the soft gasoline bag is inside of the steel gasoline tank; the steel gasoline tank is provided with a second gasoline inlet, a second gasoline measuring hole and a second manhole affording passages to the second internal space; the gasoline inlet hose of the soft gasoline bag is fixed to the 20 second gasoline inlet, the gasoline measuring hose is fixed to the second gasoline measuring hole, and the manhole hose is fixed to the second manhole.

4. The gasoline storage device according to claim 1, wherein the gasoline inlet hose is an expandable hose provided with collaring.

5. The gasoline storage device according to claim 1, wherein the gasoline measuring hose is an expandable hose provided with collaring.

6. The gasoline storage device according to claim 1, wherein the manhole hose is an expandable hose provided with collaring.

7. The gasoline storage device according to claim 1, wherein the material of the soft gasoline bag is a fabric material provided with a polyurethane coating.

* * * * *